US005443692A

United States Patent [19]

Emery

[11] Patent Number: 5,443,692

[45] Date of Patent: Aug. 22, 1995

[54] CAM ACTUATED TIMING AND OPERATING SYSTEM FOR A LEVER LOCKING MECHANISM

[76] Inventor: Roy W. Emery, 1 Donino Crt., Toronto, Ontario M4N 2H6, Canada

[21] Appl. No.: 246,809

[22] Filed: May 20, 1994

[51] Int. Cl.[6] ..... D21J 7/00

[52] U.S. Cl. ..... 162/396; 162/390; 162/392; 100/219

[58] Field of Search ..... 162/390, 391, 392–395, 162/396, 397, 407; 425/326.1, 327, 85, 271; 100/219, 269 A, 178

[56] References Cited

U.S. PATENT DOCUMENTS 3,661,707 5/1972 Emery ..... 162/391

5,174,863 12/1992 Emery et al. ..... 162/392

*Primary Examiner*—Karen M. Hastings

*Attorney, Agent, or Firm*—Marshall, O'Toole, Gerstein, Murray & Borun

[57] ABSTRACT

A cam actuated system for precisely timing and quickly operating a locking and unlocking mechanism for a quick change press, said locking and unlocking system being made of at least four locking levers, with at least two of said levers located at each side of the press, and the cam actuated mechanism including a series of at least two cam rollers which roll along the first series of at least two cam tracks for locking said press, and along a second series of at least two cam tracks, each of the series of cam tracks being fixedly mounted at a predetermined location in the travel path of the press.

1 Claim, 5 Drawing Sheets

INVENTOR

CAM ACTUATED TIMING AND OPERATING SYSTEM FOR A LEVER LOCKING MECHANISM

FIELD OF THE INVENTION

A cam actuated timing and operating system for the lever locking device of a bellows-actuated press.

BRIEF DESCRIPTION OF THE PRIOR ART

The lever type locking devices, and presses operated by a bellows action are both well known and in common use; a method of quickly exchanging one element of a pressing action is shown and described in U.S. Pat. No. 5,174,863 issued to Emery Dec. 29, 1992, and the use of a locking device is indicated by not described.

BRIEF SUMMARY OF THE INVENTION

According to one aspect of the present invention there is provided a cam actuated system for accurately timing and quickly operating a multiple lever locking and unlocking mechanism in a quick change press as said quick change press travels along a predetermined path, wherein said press is comprised of a fixedly mounted first outer element, a transferable second outer element and an intermediate pressing element, said locking and unlocking mechanism comprising at least four levers at least two of said levers being located at each side of said fixedly mounted first outer element of said quick change press, each of said levers having a locking arm and a pivoted connection to a side of said fixedly mounted outer element of said quick change press, said cam actuated system including and being actuated by a series of at least two cam rollers rolling along a first series of at least two cam tracks to actuate the lever locking stage of said operation, and along a second series of at least two cam tracks for the lever unlocking operation, each of said series of cam tracks being fixedly mounted at a predetermined location along said travel path, and said cam actuated timing and operating system further comprising: two linkage bars, one at each side of said fixedly mounted outer element, each of said linkage bars being pin-connected to each one of said lever actuating arms located at intervals along the same side of said fixedly mounted outer element; a cam wheel and a companion wheel fixedly mounted, one at each end of a common shaft, said cam wheel and said companion wheel being located at opposite sides of said fixedly mounted outer element, and each of said wheels being connected by a link pin to one of said linkage bars; said at least two cam rollers being mounted at predetermined intervals around the perimeter of said cam wheel, said first series of at least two cam tracks with a predetermined location, length, and angle of slope to deflect each of said at least two cam rollers through a predetermined arc of rotation, thus to rotate said cam wheel and said companion wheel through a predetermined total arc, and thereby to return all of said locking levers to the locking position, with each of said levers in locking contact with each of a series of locking posts appropriately located and rigidly mounted on each side of said transferable outer element of said press, all of said locking action to take place following the transfer of said transferable outer element into position on said quick change pressing mechanism, and said second series of at least two cam tracks in another arrangement of predetermined location, length, and angle of slope to deflect each of said at least two cam rollers through a predetermined arc of rotation, and thus to rotate said cam wheel and said companion wheel through a predetermined total arc of rotation, and thus to move all of said locking levers, each of which is pin-connected to one of said wheels be said linkage bars, through the predetermined total arc of rotation from the locked position to the final unlocked position, prior to the transfer of the transferable outer element.

This invention further provides a timing and operating system for an effective, fully controlled, and sufficiently quick-acting locking device to meet the locking requirements of a broad range of quick-change pressing mechanisms, generally of the type shown in said U.S. Pat. No. 5,174,863.

BRIEF DESCRIPTION OF THE DRAWINGS

In the drawings, which show one preferred embodiment of the invention.

DETAILED DESCRIPTION OF A PREFERRED EMBODIMENT

Figure 1:
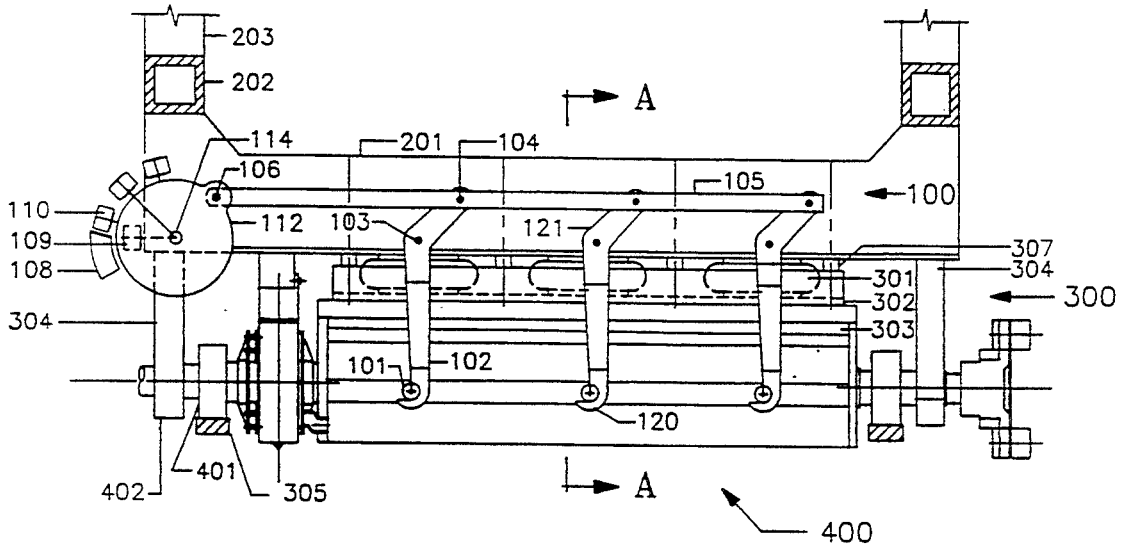
FIG. 1 is a side view of a quick-change pressing mechanism, showing the locking levers in a locked position.

In the drawings:

FIG. 1 is a side elevation of the quick-acting pressing mechanism 300 showing the fixed outer element 201 supported on the rims 202 of the rotor wheels 203, the transferable outer element 400, and the intermediate pressing element 302 which is actuated by the bellows 301 and guided in the pressing action by the guide rods 307. The wheels 402 of said outer element 400 are transferably mounted on the supports 304, and retained in place there by the track 305 supporting the wheel 401 while the locking action is taking place. Also shown is the lever type locking mechanism 100 which is comprised of: the locking posts 101 mounted on the transferable outer element 400, the locking levers 102 pivoted at pivot pins 103 which are fixedly mounted on said fixed outer element 201, said levers being linked together by the operating bar 105 at the link pins 104, and said operating bar 105 is linked in turn by link pin 106 to the wheel 112, which is rotated into the lever locking position by the action of the cam followers 110 mounted on said wheel 112 as they roll along a series of three cam tracks 108. The supporting wheel 109 on the far side of said wheel 112 resists the lateral force of the cam action.

Figure 4:
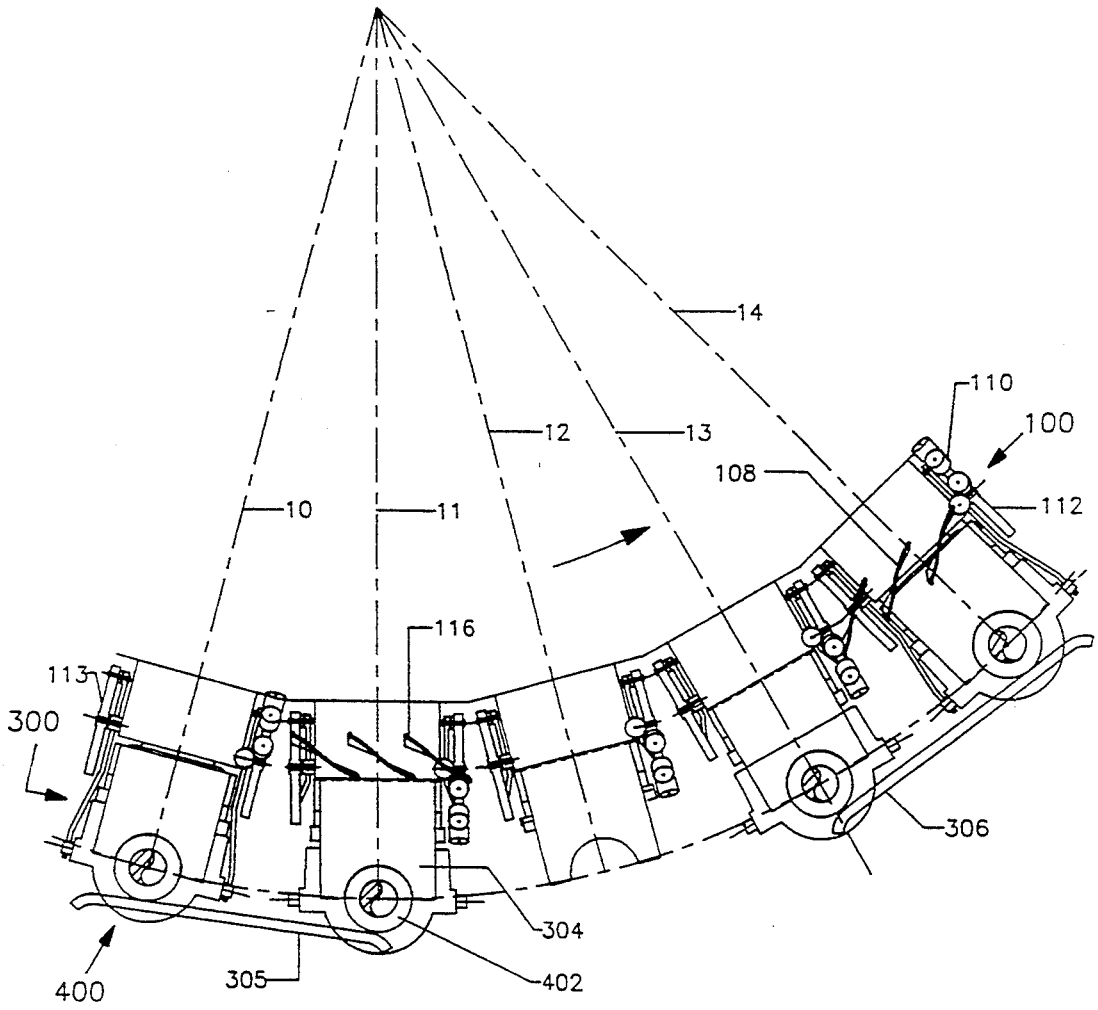
FIG. 4 is an end view of five of said quick-change pressing mechanism arranged around a portion of the supporting rotor.

The wheel 112 is mounted on a shaft 114 which extends through to the other side of said fixed outer element 201 to support there a companion wheel 113, seen in FIG. 4, which operates a similar lever locking system. Said wheel 113 does not have cam followers mounted thereon, but is rotated in unison with said wheel 112 through said shaft 114.

Figure 2:
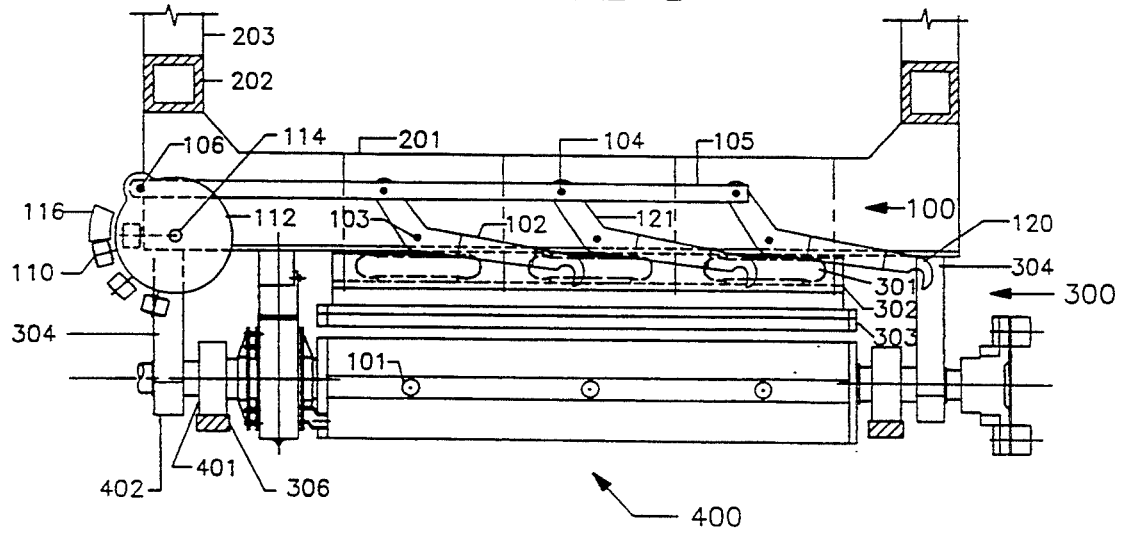
FIG. 2 is a side view of the quick-change pressing mechanism of FIG. 1, showing the locking levers in the unlocked position.

FIG. 2 is a side elevation of the quick-acting pressing mechanism 300 of FIG. 1 showing the lever locking mechanism in the unlocked position, the levers 103 having been withdrawn sufficiently to clear the travel path of said transferable outer element 400 as it is transferred to another rotor, said levers 102 having been rotated by said linking bars 105 and said wheel 112 and 113 through the action of the cam followers 110 rolling along a series of three cam tracks 116, while said transferable outer element 400 is retained in place on the fixed mounting 304 by the action of the wheel 401 rolling along track 305 while the unlocking action is taking place.

Figure 3:
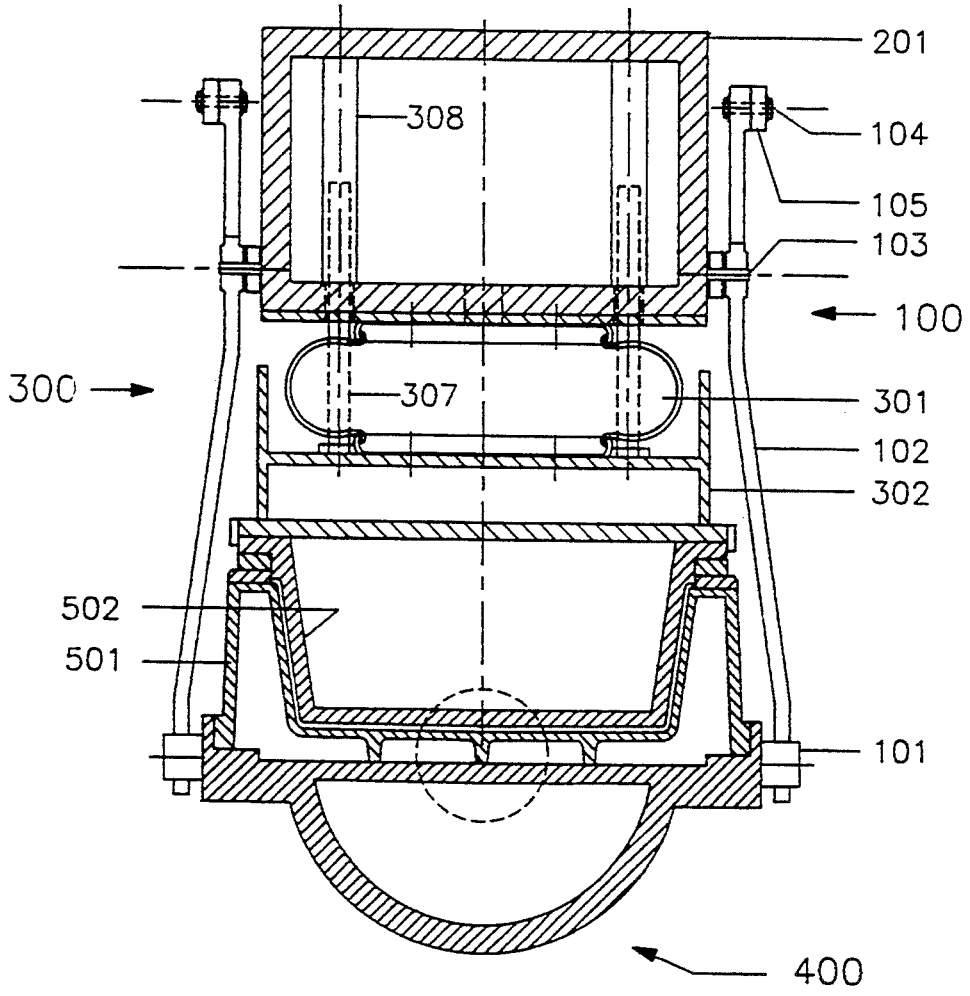
FIG. 3 is a cross-section of said quick-change pressing mechanism taken at line AA of FIG. 1.

FIG. 3 is a cross-section of the quick-acting press mechanism 300 taken at line AA of FIG. 1 showing the fixed outer member 201, the transferable outer member 400, the intermediate pressing member 302, and the levers 102 of locking system 100, all in the locked position. Said fixed outer element 201 and said transferable outer element 400 are locked together at a predetermined distance apart by the levers 102 of said locking system 100, said levers being actuated by the linking bars 105 at the link pins 104 and connected to said fixed outer element 201 by the pivot pins 103, and locked on to locking posts 101 of said transferable outer element 400. The transferable pressing die 501 is mounted on the transferable outer element 400 and mated during the pressing operated with the pressing die 502 which is fixedly mounted on said intermediate pressing element 302, said element 302 being actuated by said bellows 301, and guided in its pressing action by the guide rods 307 and the guide tubes 308.

Figure 7:
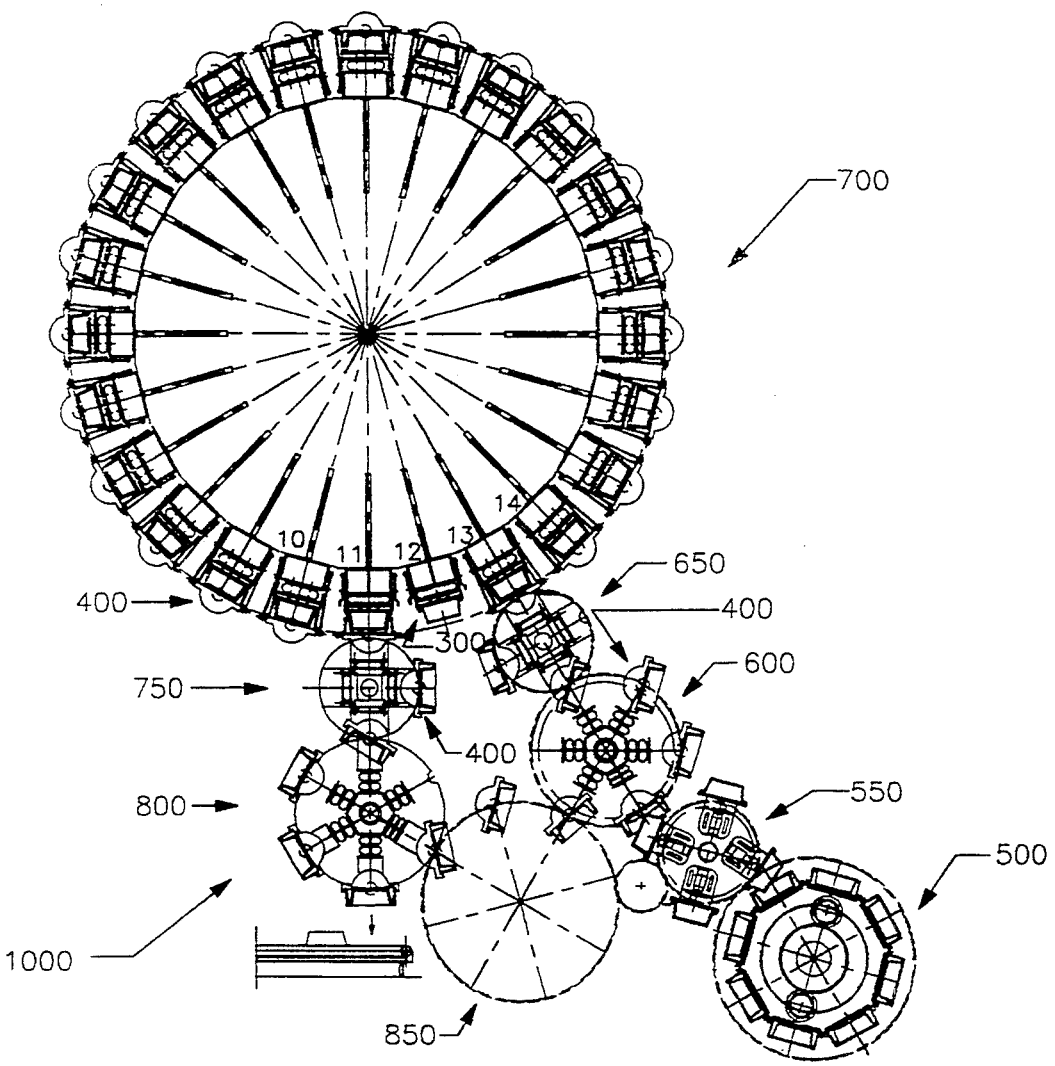
FIG. 7 is a diagram showing the arrangement of the rotors transporting the elements of the quick-acting pressing mechanisms along their continuing travel path.

FIG. 4 is an end view of five of said quick-acting pressing mechanisms 300 arranged around a portion of the perimeter of the supporting rotor 700 on FIG. 7 showing a first of said pressing mechanisms 300 in a locked position at location 10; a second already unlocked and ready for removal of said transferable outer element 400 at location 11, a third still in the unlocked position and with said transferable outer element 400 already removed at location 12, a fourth still in the unlocked position but with a replacement transferable outer element 400 already in place at location 13, and a fifth already in the locked position at location 14. While the unlocking action is taking place between locations 10 and 11 said transferable outer element 400 is retained in place on said pressing mechanism 300 by the action of wheel 402 on track 305. And while the locking action is taking place between positions 13 and 14 said transferable outer element 400 is retained in place by the action of said wheel 402 on track 306.

Figure 5:
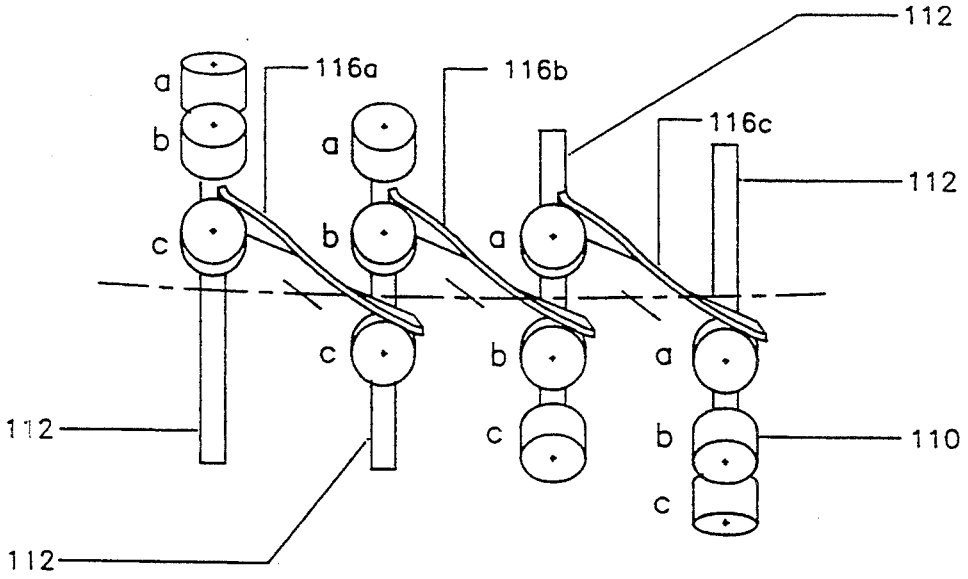
FIG. 5 is a diagram showing the cam action required to move the locking levers to the unlocked position.

FIG. 5 is a diagram illustrating the action of the cam followers 110 acting on tracks 116*a*, 116*b*, and 116*c* to rotate said wheel 112 from the locked position as shown in FIG. 1 to the unlocked position as shown in FIG. 2 as said wheel 112 travels with said pressing mechanism between location 10 and location 11 as shown on FIG. 4.

Figure 6:
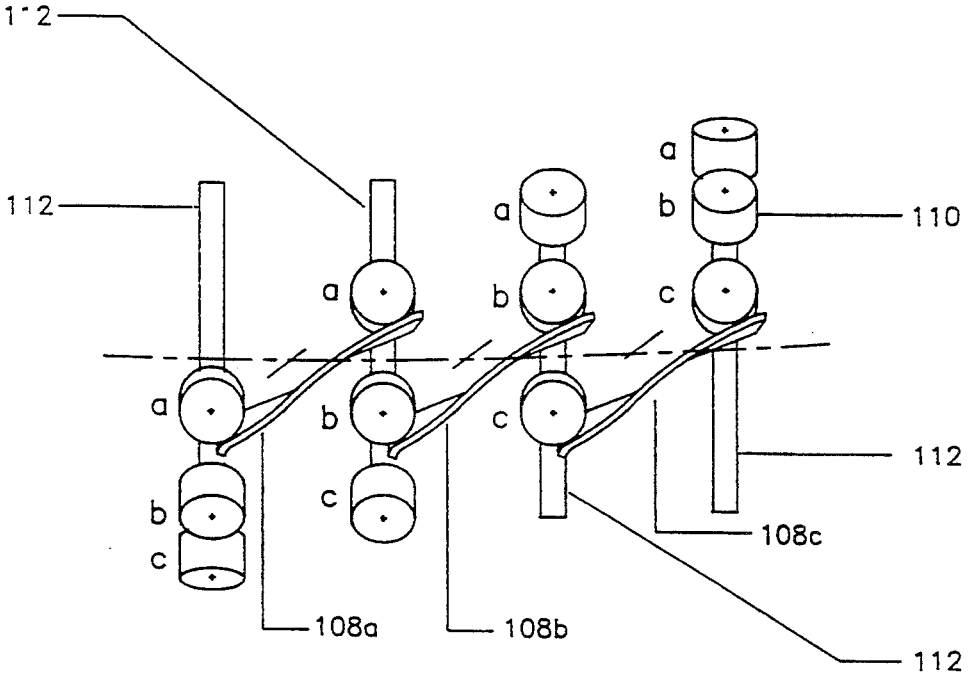
FIG. 6 is a diagram showing the cam action requirement to move the locking levers to the locked position.

FIG. 6 is a diagram illustrating the action of said cam followers 110 acting on tracks 108*a*, 108*b*, and 108*c* to rotate said wheel 112 from the unlocked position as shown in FIG. 2 to the locked position as shown in FIG. 1 as said wheel 112 travels with said pressing mechanism 300 between location 13 and location 14 as shown on FIG. 4.

FIG. 7 is a diagrammatic representation of one example of a pulp moulding and press drying system 1000 comprised of eight rotors in continuous rotation, including one moulding rotor 500, six transfer rotors numbered 550, 600, 650, 750, 800 and 850, respectively, and one press drying rotor 700, with 24 press drying locations on said rotor 700. Each of said press drying locations on said rotor 700 is fitted with a fixedly mounted outer element 201, a bellows actuated intermediate element 302, and a transferable outer element 400, except at location 12 where said outer transferable element 400 has already been removed, one of said transferable outer elements 400 being constantly and sequentially transferred from said rotor 700 to said rotor 750 beginning at location 11, and being replaced by another one of said transferable outer elements 400 transferred from rotor 650 to rotor 700 at location 13.

Typically, in operation, heated pressing dies, such as the pressing dies 502 of FIG. 3, are mounted on said intermediate pressing element 302, and mated at said location 13 with transfer and pressing dies mounted on said outer transferable element 400, such as dies 501 of FIG. 3, following which the locking of said transferable outer element 400 to said fixedly mounted outer element 201 takes place as they are rotated between locations 13 and 14.

What I claim is:

1. A cam actuated system for accurately timing and quickly operating a multiple lever locking and unlocking mechanism in a quick change press as said quick change press travels along a predetermined path, where said press is comprised of a fixedly mounted first outer element, a transferable second outer element and an intermediate pressing element, said locking and unlocking mechanism comprising at least four levers, at least two of said levers being located at each side of said fixedly mounted first outer element of said quick change press, each of said levers having a locking arm and a pivoted connection to a side of said fixedly mounted outer element of said quick change press, said cam actuated system including and being actuated by a series of at least two cam rollers rolling along a first series of at least two cam tracks to actuate the lever locking stage of said operation, and along a second series of at least two cam tracks for the lever unlocking operation, each of said series of cam tracks being fixedly mounted at a predetermined location along said travel path, and said cam actuated timing and operating system further comprising:

two linkage bars, one at each side of said fixedly mounted outer element, each of said linkage bars being pin-connected to each one of said lever actuating arms located at intervals along the same side of said fixedly mounted outer element;

a cam wheel and a companion wheel fixedly mounted, one at each end of a common shaft, said cam wheel and said companion wheel being located at opposite sides of said fixedly mounted outer element, and each of said wheels being connected by a link pin to one of said linkage bars;

said at least two cam rollers being mounted at predetermined intervals around the perimeter of said cam wheel;

said first series of at least two cam tracks with a predetermined location, length, and angle of slope to deflect each of said at least two cam rollers through a predetermined arc of rotation, thus to rotate said cam wheel and said companion wheel through a predetermined total arc, and thereby to return all of said locking levers to the locking position, with each of said levers in locking contact with each of a series of locking posts appropriately located and rigidly mounted on each side of said transferable outer element of said press, all of said locking action to take place following the transfer of said transferable outer element into position on said quick change pressing mechanism, and said second series of at least two cam tracks in another arrangement of predetermined location, length, and angle of slope to deflect each of said at least two cam rollers through a predetermined arch of rotation, and thus to rotate said cam wheel and said companion wheel through a predetermined total arc of rotation, and thus to move all of said locking levers, each of which is pin-connected to one of said wheels by said linkage bars, through the predetermined total arc of rotation from the locked position to the final unlocked position, prior to the transfer of the transferable outer element.

* * * * *